US009365390B2

(12) United States Patent
Lutnesky et al.

(10) Patent No.: US 9,365,390 B2
(45) Date of Patent: Jun. 14, 2016

(54) CABLE CONFIGURATION ASSISTANCE

(71) Applicant: HEWLETT-PACKARD DEVELOPMENT COMPANY, L.P., Houston, TX (US)

(72) Inventors: Gary G. Lutnesky, Corvallis, OR (US); Kevin E. Swier, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 341 days.

(21) Appl. No.: 13/897,131

(22) Filed: May 17, 2013

(65) Prior Publication Data

US 2014/0338950 A1 Nov. 20, 2014

(51) Int. Cl.

| | |
|---|---|
| ***B65H 75/34*** | (2006.01) |
| ***B65H 75/48*** | (2006.01) |
| ***B65H 75/36*** | (2006.01) |

(52) U.S. Cl.

CPC ..... *B65H 75/48* (2013.01); *B65H 75/36* (2013.01); *B65H 2701/34* (2013.01)

(58) Field of Classification Search

CPC ..... B65H 75/34
USPC ..... 174/69
See application file for complete search history.

(56) References Cited

U.S. PATENT DOCUMENTS

| | | | | |
|---|---|---|---|---|
| 3,281,765 | A * | 10/1966 | Taplin | G10K 11/006 174/69 |
| 3,833,070 | A * | 9/1974 | Anderson | 173/164 |
| 3,904,840 | A * | 9/1975 | Kostelnicek | E21B 17/003 174/47 |
| 5,118,907 | A * | 6/1992 | Stout | B65H 75/362 174/135 |
| 6,396,414 | B1 * | 5/2002 | Bickford | H01B 7/065 174/47 |
| 8,179,327 | B1 * | 5/2012 | Clark | H01Q 1/34 114/328 |
| 8,288,973 | B2 | 10/2012 | Ford | |
| 2005/0282586 | A1 | 12/2005 | Rutherford et al. | |
| 2011/0006174 | A1 | 1/2011 | Hollinger | |
| 2011/0012003 | A1 | 1/2011 | Woodruff et al. | |

OTHER PUBLICATIONS

Genie. Terex AL5. http://www.genielift.com.

* cited by examiner

*Primary Examiner* — Jenny L Wagner
*Assistant Examiner* — Michael P McFadden
(74) *Attorney, Agent, or Firm* — HP Inc. Patent Department

(57) ABSTRACT

In one implementation, a cable assistance apparatus includes a cable including a segment having a helical shape about an axis and an assist mechanism operatively connected to the cable. The assist mechanism may apply a force to adjust the segment from a first configuration to a second configuration. The first configuration may have a first span measured along the axis from a first end of the segment to a second end of the segment, and the second configuration may have a second span measured along the axis from the first end of the segment to the second end of the segment.

16 Claims, 5 Drawing Sheets

CABLE CONFIGURATION ASSISTANCE

BACKGROUND

Oil and gas explorations commonly employ seismic surveys to determine the location, nature, and likely quantity of oil and gas deposits disposed below the ground. A signal may be directed into a rock formation and the reflection of the signal may be received by a plurality of seismic sensors positioned at different points along the surface. The variations in the reflected signals may then be used to determine the likely location of oil and gas and other mineral deposits within the formation. Some seismic surveys may incorporate hundreds of portable masts that may be moved to different locations and may require conformity to a variety of operational specifications in order to be effective in the types of environments that seismic surveys are typically conducted. The masts may have electrical, communication, or diagnostic requirements and electrical cables may be used, disconnected, stowed, and transported between locations.

DETAILED DESCRIPTION

In the following description and figures, some example implementations of cable assistance apparatus and/or systems are described. Some examples of a cable assistance apparatus and/or system are described specifically for use in a system for carrying out seismic surveys. However, it should be noted that examples of the cable assistance system described herein may be utilized in a wide variety of systems and applications. In particular, the cable assistance system may provide an electrically conductive cable connection to systems and/or devices which employ a cable or cables to provide an electrical medium to power a system or device and/or communicate with the system or device by signal transmission while still complying with the principles disclosed herein. Therefore, seismic surveys are merely one of many potential uses of the cable assistance apparatus and system described herein. Thus any reference to seismic surveys and related subject matter is merely included to provide context for specific examples described herein. The disclosed apparatuses and systems may be applied to other environments and implementations.

A cable may be susceptible to damage by the environment or by user neglect, such as improper stowage. Seismic surveys are sometimes taken in harsh environments including deserts which may have extreme temperatures, both high and low, as well as environmental factors, such as sand, dirt, wind, rain, ultraviolet ("UV") rays. These factors may hinder successful or efficient implementation of seismic surveys. For example, cables may need to be protected from heat and weather elements to avoid damage, deterioration, or deformation and from dirt or sand that may clog or obstruct moveable features of a system. Seismic surveys may require setting up and moving hundreds of masts to obtain a sufficient amount of data. Connecting and disconnecting such a plenitude of masts from electrical sources can be tedious, time-consuming, and/or inefficient. Each transport of a mast can make the cables susceptible to bending, cutting, or other damage to the cable and the cable may become less than desirable for operation if not completely inoperable. These factors may be taken into consideration to produce a portable mast and antenna system for producing seismic surveys. Every modification made to reduce set up and take down time may aggregate to large improvements in overall deployment and data capture efficiency. In particular, it may be desired to have a cable connected to the antenna system that retracts into a protective housing for stowage. Various embodiments are described below by referring to several examples.

Figure 1:
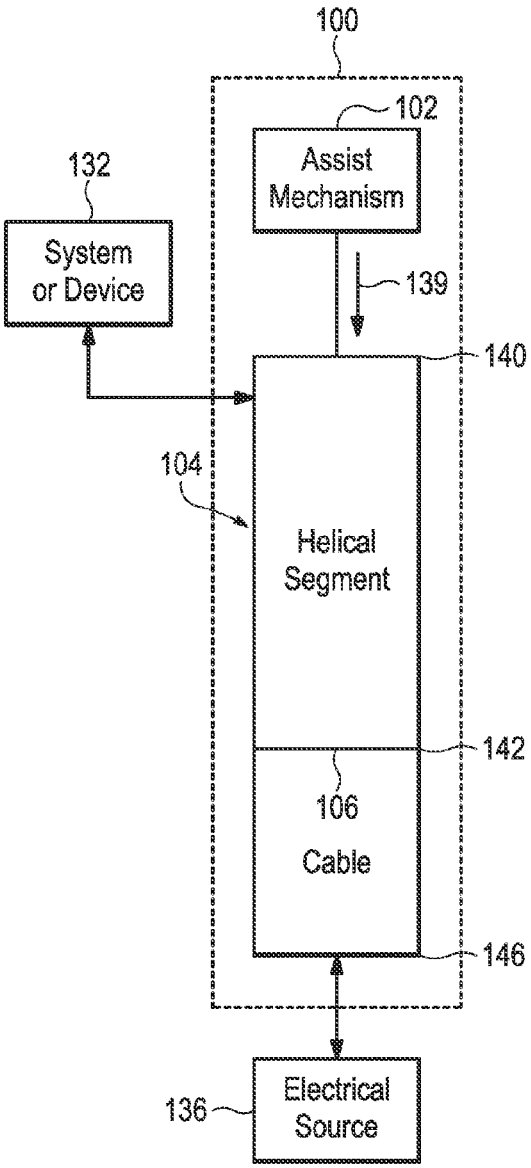
FIG. 1 is a block diagram of one example of a cable assistance apparatus.
Figure 2:
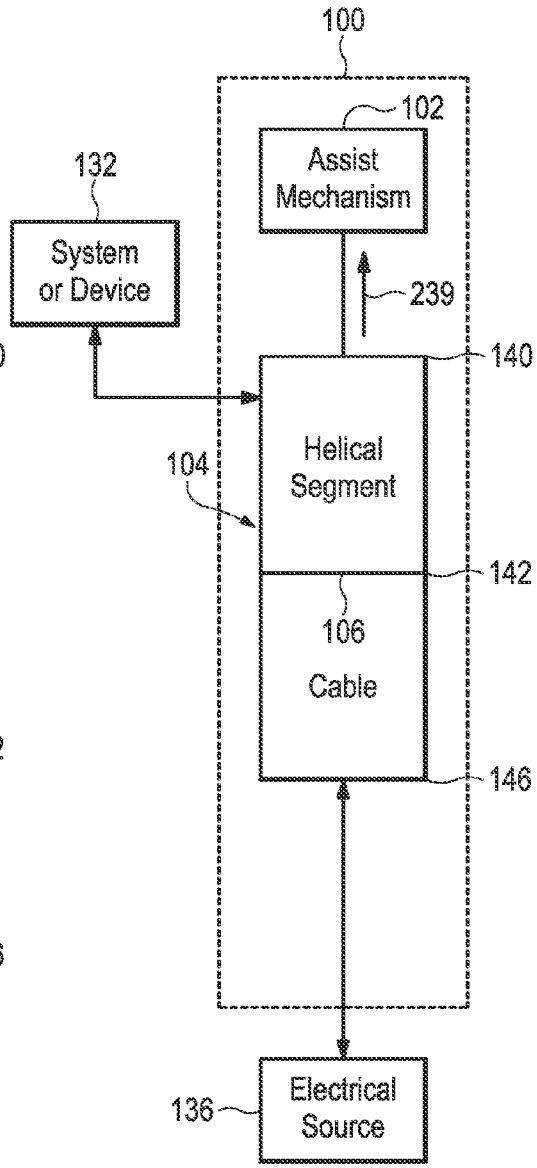
FIG. 2 is a block diagram of one example of a cable assistance apparatus.

FIGS. 1 and 2 are block diagrams of examples of a cable assistance apparatus 100. Referring to FIGS. 1 and 2, one example cable assistance apparatus 100 may generally comprise a cable 104 and an assist mechanism 102. The assist mechanism 102 may be operatively connected to the cable 104. The assist mechanism 102 may provide assistance to adjust configuration of the cable 104. For example, the assist mechanism 102 may assist retraction and/or extension of the cable 104. FIG. 1 depicts that the assist mechanism 102 may apply a force 139 on the cable 104 where the force 139 may extend the configuration of the cable 104. FIG. 2 depicts that the assist mechanism 102 may apply a force 239 on the cable 104 to retract the configuration of the cable. The assist mechanism 102 may enable the change among configurations based on the force provided by the assist mechanism 102.

The cable 104 may have a first end connectable to a system or device 132 and a second end connectable to an electrical source 136. The cable 104 may be electrically conductive to provide electrical power to the system or device 132 and/or to provide a communication medium between the electrical source 136 and the system or device 132. One example of communication over the communication medium may be retrieval of diagnostic information from the system or device 132 to the electrical source 136.

The cable 104 may have a portion that has a shape or bias that is nonlinear. The cable 104 may have a length along the shape of the cable 104 from one end 140 to another end 146. The length of the cable 104 may be different from the effective length when the cable 104 is shaped or biased and the effective length is the direct distance between end 140 and end 146.

The cable 104 may include multiple segments and each segment may have a shape or bias that is different or the same as another segment. Each segment may have a span from one end of the segment to another end of the segment. For example, the cable 104 may have a helical segment 106 and the helical segment 106 may have a distance spanned, or span, from an end 140 to an end 142. The effective length of the cable 104 may include all the segments of cable 104. For example in FIGS. 1 and 2, the effective length of the cable 104 may include the distance (or span) from end 140 to end 142 and the distance from end 142 to end 146.

The effective length of the cable 104 may change in conjunction with a change in shape or configuration of a segment of the cable 104. The helical segment 106 may be configurable to change distance spanned from a first end 140 of the helical segment 106 to a second end 142 of the helical segment 106. For example, the helical segment 106 could be stretched to increase the span from one end 140 to end 142. The span of the helical segment 106 may directly relate to the effective length of the entirety of cable 104. For example, the effective length of the cable 104 may be greater when the helical segment 106 is stretched, such as in FIG. 1, than when the helical segment 106 is compacted, such as in FIG. 2. In that example, an extension configuration of the helical segment 106 may result in an extended effective length of the cable 104 and, similarly, a retraction configuration of the helical segment 106 may result in a retracted effective length of the cable 104.

The cable 104 may be adjustable among a plurality of configurations and/or positions based on the configuration of a segment 106 of the cable 104. For example in FIG. 1, the helical segment 106 may be in an extension configuration where the helical segment 106 is stretched to increase the span between the end 140 and the end 142. As another example in FIG. 2, the helical segment 106 may be in a retraction configuration where the helical segment 106 is compacted to decrease the span between the end 140 and the end 142. Between those two examples, the span of the helical segment 106 in FIG. 1 may be greater than the span of the helical segment 106 in FIG. 2 and, similarly, the effective length of the cable 104 in FIG. 1 may be greater than the effective length of the cable in FIG. 2. In general, when the helical segment 106 is in a retraction configuration, the span of the helical segment 106 may be relatively short and result in a retracted effective length of cable 104 that may be shorter than the extended effective length of a cable 104 with a helical segment 106 that is in an extension configuration and has a relatively longer span.

The cable 104 may have a rest configuration based on the bias of the shape of the cable 104. For example, a cable 104 may have been molded to bias in a helical shape when no force is placed on the cable 104. In that example, the rest configuration of the cable 104 may also be a retraction configuration. The cable 104 may adjust in configuration by a change in bias of the shape of the cable 104. For example, a segment 106 may be commercially available as biased in a helical shape, but forces or environmental factors may change the bias of the helical shape, such as by heat or stretch of the cable 104. In that example, the rest configuration of the cable may have a longer effective length than the effective length of the cable in a retraction configuration.

The configuration of the helical segment 106, and the effective length of the cable 104, may change in relation to a force 139 or force 239 applied. The assist mechanism 102 may be able to apply one or both of forces 139 and 239. The assist mechanism 102 may include a mechanism to apply a force such as a solenoid, a motor, or a crank. The assist mechanism 102 may apply one of forces 139 and 239 on a segment 106 of cable 104 to maintain or change the position, shape, and/or other configuration of the cable 104 and/or a segment of the cable 104. For example, assist mechanism 102 may include a motor operatively connected to the cable 104 at a point on the cable 104, such as an end 142. In that example, the motor may push and or pull on the end of the cable 104 to change the span of the cable segment 106 and, in turn, change the effective length of cable 104. In another example, a motor may provide an extension force 139, as depicted in FIG. 1, to stretch the segment 106 and, thereby, increase both the span of the segment 106 and the effective length of the cable 104. Similarly, the motor may provide a retraction force 239, as depicted in FIG. 2, to compact the segment 106 of the cable 104 and, thereby, reduce both the span of the segment 106 and the effective length of the cable 104.

The helical segment 106 in conjunction with the assist mechanism 102 may provide retraction capabilities without requiring spooling of the cable 104 where such methods may become jammed, kinked, or knotted as the cable 104 changes configurations and may hinder extension or retraction of cable 104. Retraction and extension configurations of the cable 104 may be desirable in oil and gas explorations when the cable 104 is connected to an antenna system 132 of a portable mast. The cable 104 may be in a retraction configuration prior to deployment and/or during transport. The cable configurations may also prove useful in an environment that requires transportation of the cable 104 and/or protection from environmental factors, such as weather conditions. For example, deployment of electronics for military communications may require relatively quick set up and take down as well as protection from environmental factors, such as sand and wind in a desert environment. Consumer electronics may also require assistance in organizing an electrically conductive cable 104, in particular mobile devices that may need electrical power during transport, such as at an airport. For example, the cable assistance apparatus 100 may provide a connection between a mobile device 132 and an electrical source. In another example, the cable 104 may provide a connection medium that communicates from a Universal Serial Bus ("USB") connection to an electrical outlet to charge the device. The cable assistance apparatus 100 may be of a desired length to be compact enough for, in the example of seismic surveys, fitting in the cargo area of a transportation vehicle, or storing in luggage or a backpack. This may provide an advantage to a user of a mobile device 132 who travels often.

Figure 3:
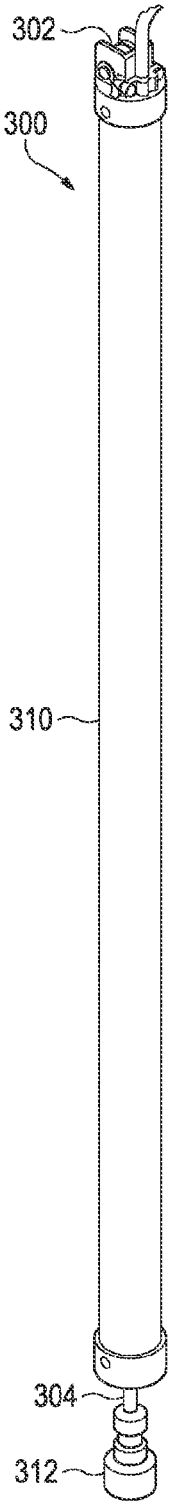
FIG. 3 is a perspective view of one example of a cable assistance apparatus in a retraction configuration.
Figure 4:
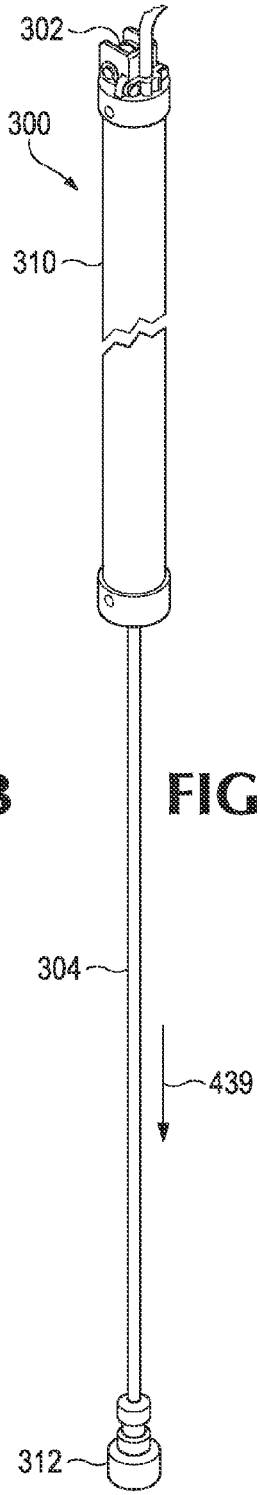
FIG. 4 is a perspective view of one example of a cable assistance apparatus in an extension configuration.

FIGS. 3 and 4 are perspective views of examples of a cable assistance apparatus 300. Referring to FIGS. 3 and 4, one example of a cable assistance apparatus 300 may generally comprise a cable 304, an assist mechanism 302, and a housing 310. The assist mechanism 302 may provide assistance to adjust configuration of the cable 304. FIG. 3 is an example of the cable assistance apparatus 300 with the cable 304 in a rest and/or retraction configuration. FIG. 4 is an example of the cable assistance apparatus 300 with the cable 304 in an extension configuration.

The assist mechanism 302 may apply a force on the cable 304 such that the cable 304 may change configuration. For example, the cable 304 may be in a rest configuration that is different from a retraction configuration where a portion of the cable 304 may remain outside of the housing 310 unprotected from bending, damage, or environmental factors in a rest configuration. In that example, the assist mechanism 302 may operatively connect to a portion of the cable 304 and apply a force on that connection to pull the cable 304 towards the assist mechanism 302. The result may move the position of the portion of the cable 304 that was outside of the housing 310 to inside the housing 310 where the cable 304 may be protected from damage. In another example, the assist mechanism 302 may also apply a force to push and/or pull on the cable 104 to change configuration and/or position of the cable 104.

A change in configuration may occur when the force is applied upon removal or reduction of an external force 439. For example, when the external three 439 is applied on the apparatus, the configuration of the cable assistance apparatus 300 may change from the retracted configuration of FIG. 3 to the extension configuration of FIG. 4. For another example, upon disconnecting a connector 312 attached to the cable 304 from an electrical source, the external force 439 applied by the connection may be released and the assist mechanism 302 may apply a force on the cable 304 to adjust the cable 304 from an extension configuration, such as depicted in FIG. 4, to a retraction configuration, such as depicted in FIG. 3. The assist mechanism 302 may change the configuration of cable 304 according to the desired purpose. For example, a retraction configuration may be desired to protect and stow the cable 304 while transporting the portable mast and antenna system to another location.

Figure 5:
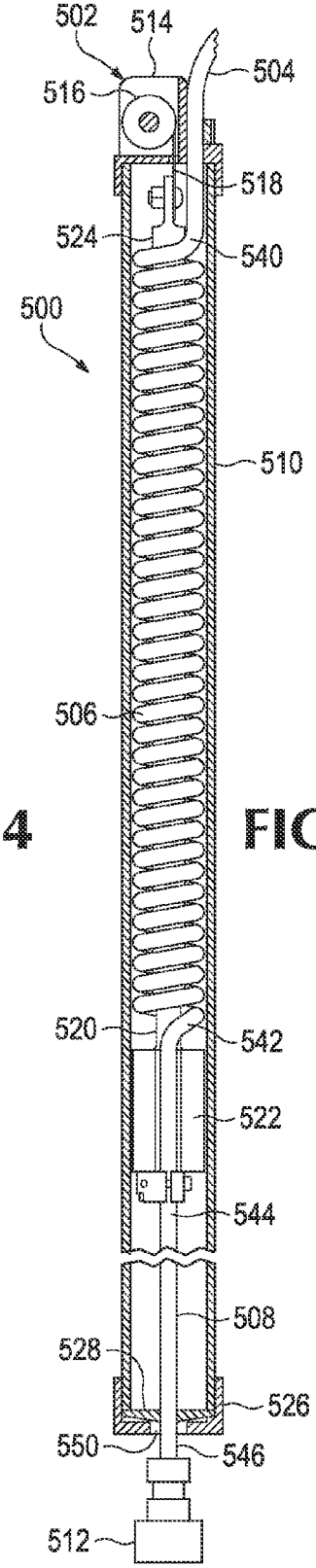
FIG. 5 is a cutaway view of one example of a cable assistance apparatus.
Figure 6:
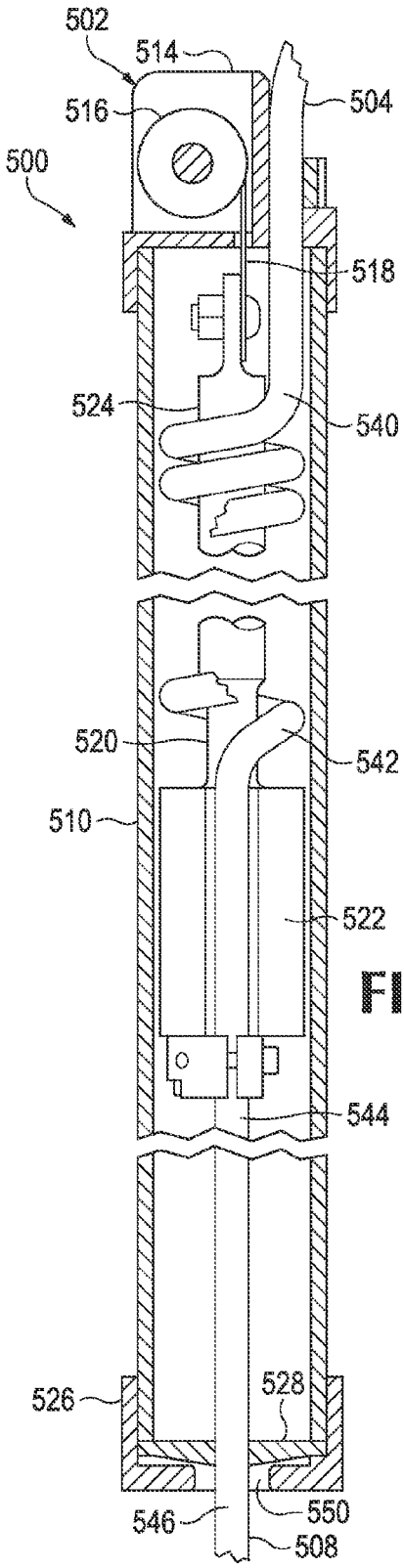
FIG. 6 is an enlarged cutaway view of one example of a cable assistance apparatus in a retraction configuration.
Figure 7:
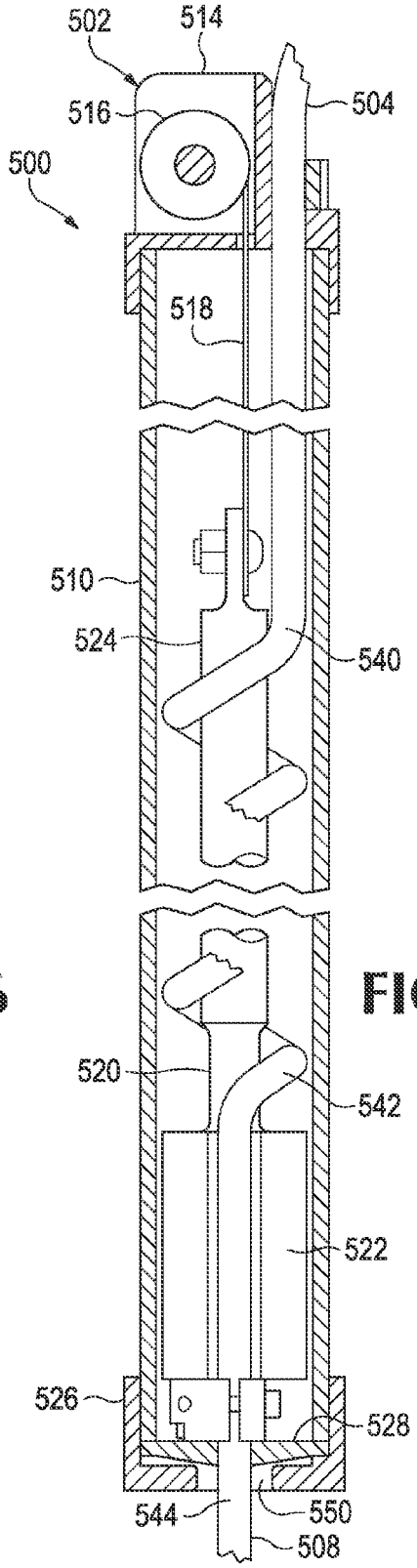
FIG. 7 is an enlarged cutaway view of one example of a cable assistance apparatus in an extension configuration.

FIGS. 5-7 are cutaway views of examples of a cable assistance apparatus 500. FIG. 6 is an enlarged view of the cable assistance apparatus 500 in one example of a retraction configuration and FIG. 7 is an enlarged vim of the cable apparatus 500 in one example of an extension configuration. Referring to FIGS. 5-7, one example of a cable assistance apparatus 500 may generally comprise a cable 504, a spring assembly 514, a plunger assembly 520, and a housing 510. The cable 504 may have multiple segments. Segments of the cable 504 may be separated and/or attached by connectors, and the segments may be made of different materials. Cable segments may be helical in shape and or non-helical in shape. For example in FIG. 5, the cable 504 may include a first segment 506, depicted between a first point 540 of the cable 504 and a point 542 of the cable 504, having a helical shape and a second segment 508, depicted between a third point 544 of the cable 504 and a fourth point 546 of the cable 504, that does not have a helical shape. For another example, the cable may include two helical segments, where one segment may remain in a housing and the other segment may change positions from inside the housing to outside the housing. The helical-shaped segment 506 may form a helix about an axis generally being the line made along the interior of the helix made by connecting center points of a space curve.

The helical shape and/or the properties of the material of the cable 504 may allow the cable 504 to change configuration. A change in configuration may be an adjustment in the width of a pitch of the helix or one complete turn, or loop, of a helix measured parallel to the axis. For example, FIG. 6 shows a pitch of the helical segment 506 that may be less than the pitch of the helical segment 506 in FIG. 7. The change in pitch of the helical segment 506 may result in a change in the distance from one end of the helical segment of cable 504 at point 540 to the other end of the helical segment 506 at point 542 as measured along the axis (i.e., a change in the space of the helical segment 506). Such a change may provide stretch and/or extension of the helical segment 506 of the cable 504. For example in comparing FIGS. 6 and 7, as the pitch increases, the span from point 540 to point 542 along the axis increases, and the cable 504 may effectively increase in length (i.e., the effective length of the cable 504 increases). Similarly, as the pitch decreases, the span decreases, and the cable 504 may effectively decrease in length (i.e., the effective length of the cable 504 decreases). Accordingly, the span of the helical segment 506 may directly relate to the effective length of the cable 504. The cable 504 may have a resting configuration, such as a retraction configuration depicted in FIG. 5, where the helical shape of helical segment 506 has a relatively small pitch or where the loops of the helical segment 506 abut each other.

Environmental factors may modify or alter the bias of the helical segment 506 in the resting configuration to be a different configuration from the retracted configuration. For example, desert temperatures may reduce the tension and/or bias of a helix-shaped segment 506 and increase the pitch where some of the loops of that helix-shaped segment may no longer abut or the pitch between loops may be greater than a desired spacing threshold. In that example, the result may be a span of the helical segment 506 that is beyond a desired threshold retraction span and/or an effective length of the cable 504 that is beyond a desired threshold retraction effective length. The assist mechanism 512 may provide a sufficient force on the helical segment 506 to reduce the span of the helical segment 506 and the result of compacting the helical segment 506 may be a reduction in the effective length of the cable 504. FIG. 5 depicts a compacted helical segment 506 within the cable assistance apparatus 500.

Generally, if a sufficient force is placed on the cable 504, the helical segment 506 may adjust in configuration. For example, the helical segment 506 may adjust to an extension configuration when the cable 504 is pulled on. The extension configuration may be different from the retraction configuration. For example in FIG. 7, the extension configuration may have an increase in pitch and span between the points 540 and 542 of the helical segment 506 in comparison to the retraction configuration depicted FIG. 6 and the effective length of the cable 504 (i.e., the distance from the point 540 to the point 546) may increase.

One segment 508 of the cable 504 may move in conjunction with the change in configuration. For example, the segment 508 may be non-helical, depicted in FIG. 5 from point 544 to point 546, and may be in a retraction position when the helical segment 506 is in a retraction configuration. The retraction position may be where point 544 is near a minimum threshold distance from point 540 based on the span of the helical segment 506 in a retraction configuration. Similarly, the helical segment 506 may move to an extension configuration when the non-helical segment 508 moves into an extension position. For example FIG. 7, the position of point 544 of the non-helical segment has moved from inside the housing 510 to outside the housing 510.

The cable 504 may be electrically conductive and may provide power and/or communication signals. The cable 504 may contain multiple conductors and a shield. Other types or combinations of cables may be used to produce the desired multi-conductor wire construct. The cable 504 may have a jacket for protection such as a polyurethane jacket. Other materials may be used for the jacket that provides flexibility, elasticity, and/or tension. The cable 504 may also have a segment that was heated and/or molded to bias in a helical shape. The cable 504 may provide natural tension force produced from the material used and/or the method for molding the helical segment 506 of the cable 504 into a helical shape.

The cable 504 may have a connector 512 to connect to a port of an electrical source. The connector 512 may be placed on a non-helical segment 508 of the cable 504 to allow the connector 512 to adjust positions to connect to the electrical source. The connector 512 may provide an electrically conductive connection compatible with the electrical source. For example, the connector 512 may provide a USB connection or a Power over Ethernet ("PoE") connection.

A change in configuration of the cable 504 may be assisted by an assist mechanism 502. The assist mechanism 502 may be operatively coupled to the cable 504. If an external force is applied to the cable 504, the assist mechanism 502 may provide an assistive force in a direction opposite to the external force. This may allow the helical shape 506 of the cable 504 to adjust configuration. For example, the cable 504 may return from an extension configuration, such as in FIG. 7, to a retraction configuration, such as in FIGS. 5 and 6, or a resting configuration by applying the force provided by the assist mechanism 502. A change in configuration may also include a change in position of other segments of the cable 504, such as the non-helical segment 508.

The assist mechanism 502 may include a spring assembly 514 to provide the force to adjust the configuration of the helical segment 506 of the cable 508. The assist mechanism 502 may include a plunger assembly 520. The spring assembly 514 may be operatively connected to the plunger assembly 520 to apply the force provided by the spring assembly 514 to the cable 504. The spring assembly 514 may be connected to the housing 510 to provide a fixed end.

The spring assembly 514 may include a mechanism to provide force on the cable 504 such as a constant force spring, extension spring, or equivalent. FIGS. 5-7 depict one example of a spring assembly 514 having a constant force spring and may include a spool segment 516 and a tape segment 518. The spool segment 516 may wind in a spiral and have an exterior end that may attach to the cable 504 or the plunger assembly 520. FIGS. 5-7 depict the tape segment 518 fastened to the plunger assembly 520. When using a constant force spring, the spring assembly 514 may provide a substantially constant force as the tape segment 518 is pulled out or unwound from the spool segment 516. In other words, spring assembly 514 provides the same amount of force regardless of the length of the tape segment 518 or length of the spool segment 516.

The tape segment 518 may follow the change in configuration of the helical segment 506 and may move substantially along the axis of the helical shape as depicted by FIGS. 6 and 7. The material of the spring assembly 514 and bias of the spool segment 516 may determine the amount of force provided by the constant force spring of the spring assembly 514. For example, the spool segment 516 and tape segment 518 may be made out of spring steel and biased to curl into a spool shape or spiral. A constant force spring may provide adequate force in a relatively small mechanism and may be preferable for use in mechanical environments with space constraints. If housing 510 allows for a larger spring assembly (e.g., has a diameter sufficient to accommodate), then other springs, such as an extension spring may be used.

The spring assembly 514 may apply a force on the plunger assembly 520 substantially along the axis of the helical segment 506 of the cable 504. The spring assembly 514 may provide a force small enough that an external force, such as a person, may be able to overcome the force and pull on the cable 504 for payout. Once that external force is removed, the force provided by the spring assembly 514 may retract the cable 504 towards a distal end of the housing 510 by winding the spool segment 516 and pulling the tape segment 518 along the axis. If sufficient retraction force is provided by the spring assembly 514 and/or the configuration allows, the entirety of cable 504 may be retracted into the housing 510.

It may be desirable to generate a specific rate of retraction sufficient to retract at least part of the cable 504 by providing adequate force from the spring assembly 514, but below a rate of retraction that may disturb the cable assistance apparatus 500 from functioning properly or disturb users of the cable assistance apparatus 500. For example, it may be desirable to limit the spring assembly 514 from providing a force to surpass a threshold rate of retraction that may be dangerous to the cable assistance apparatus 500 or a user operating the cable assistance apparatus 500. One to three pounds of force provided by a constant force spring may be sufficient to retract the cable 504 at a rate that may not disturb the user of the cable assistance apparatus 500 and may be sufficient to retract the helical segment 506 of the cable 504 into the housing 510.

A plunger assembly 520 may work in conjunction with the spring assembly 514 and transfer the force provided by the spring assembly 514 onto the cable 504. The plunger assembly 520 may include a head 522 and a body 524. The plunger body 524 of the plunger assembly 520 may be coupled to the spring assembly 514. For example in FIGS. 5-7, the plunger body 522 may be fastened to the tape segment 518 of the spring assembly 514. The plunger body 522 may be attached to the spring assembly 514 by a screw or other fastener.

The plunger body 522 may move substantially along the axis of the helical segment 506 of the cable 504. For example, the tape segment 518 of the spring assembly 514 may extend along the interior of the helix made by the helical segment 506 and provide a force to pull the plunger body 524 substantially along the axis of the helix. As depicted in FIGS. 5-7, the plunger body 524 may generally lie and/or extend along the axis of the helical segment 506 of the cable 504, and the helical segment 506 may be wrapped around the plunger body 524 to provide for organization and may facilitate reliable operation of the cable 504 during changes in configuration. For example, the plunger assembly 520 may hinder the helical segment 506 of the cable 504 from kinking or uncoiling by guiding the helical segment 506 to move laterally along the interior of the housing 510. The plunger body 524 may also hinder the cable 504 from retracting passed a specific point in the housing 510 by contacting the spring assembly 514 or housing 510.

The head 522 of the plunger assembly 520 may be coupled to the body 524 of the plunger assembly 520 and be operatively coupled to the cable 504. The force applied on the plunger body 524 may move the plunger body 524 and plunger head 522 substantially along the axis of the helical segment 506 of the cable 504. For example, when an external force pulls on the cable 504, the plunger head 522 may move from a retraction position depicted in FIG. 6 to an extension position depicted figure where the plunger head 522 may be positioned near an end of the housing 510. Similarly, once the external force no longer acts on the cable 504, the spring assembly 514 may retract the tape segment 518 and pull the plunger head 522 from an extension position depicted FIG. 7 to a retraction position depicted in FIG. 6. In turn, the plunger head 522 may apply a force on the cable 504. The plunger head 522 may have a surface sufficient to contact the helical segment 506 of the cable 504 and apply the force on the cable 504 to change the configuration of the helical segment 506. For example in FIG. 6, the surface of the head 522 of the plunger assembly 520 may be sufficiently large that it may contact part of a first loop of the helical segment 506 at point 542. The plunger assembly 520 may move and the plunger head 522 may contact the first loop of the helical segment 506 towards a second loop and may compact the first loop and second loop by decreasing the pitch between the first loop and second loop.

The plunger head 522 of the plunger assembly 520 may also have an opening to receive the cable 504. For example in FIGS. 5-7, the opening may allow for a portion of cable 504 to fit inside the plunger head 522 and pass through the plunger head 522 to continue along the inside of the housing 510 and/or out of the housing 510. The plunger head 522 may couple to the segment of cable 504 inside the opening. The plunger head 522 may be positioned at the point where a helical segment 506 of the cable 504 ends and a non-helical segment 508 begins, as depicted in FIGS. 5-7 between points 542 and 544, or otherwise between two segments of the cable 504. One example may position the plunger head 522 between two separate cables and the plunger head 522 may provide an electrically conductive connection between the two separate cables. At least one of the segments of cable 504 may move in conjunction with the movement of the plunger head 522.

A housing 510 may be placed around at least a part of the assist mechanism 502, such as in FIG. 5. The housing 510 may form a space sufficient to contain a portion of the cable 504 or the entire cable 504. There may be a clearance sufficiently sized between the housing 510 and the assist mechanism 514 and/or cable 504 as to not restrict the movement of the cable 504 or a plunger assembly 520. The clearance at a portion of the housing 510 may be sufficiently small to provide friction against the cable 504 and/or assist mechanism 502 to reduce the rate of change of configuration of a segment of the cable 504 or the rate at which the cable 504 retracts or extends. For example in FIG. 5, the clearance may allow for the housing 510 to provide a frictional force on the plunger head 522 as the helical segment 506 changes configuration. The housing 510 may provide assistance to the cable 504 by guiding the cable 504 and/or organizing the cable 504 to hinder kinking or uncoiling. The clearance may be sufficient to allow for environmental factors to pass through or otherwise reduce the effect of the environmental factors on the workings of die assist mechanism 502 and/or cable 504. Environmental factors may include sand, pebbles, dirt, vegetation, insects, wind, rain or other elements consistent with the environment and location where seismic surveys are deployed. The housing 510 may be made of light weight and/or sturdy material, such as carbon fiber or aluminum. The housing 510 may be made out of commercially available tubing.

The housing 510 may also include an end cap 526. The end cap 526 may be coupled and/or fastened to the housing 510. A portion of the end cap 526 may form an access point 550 to receive a segment of the cable 506. In FIGS. 5 through 7, the access point 550 receives the non-helical segment 508 of the cable 504. The access point 550 may be of a size large enough to allow a connector 512 of the cable 504 to pass through and allow the cable 504 and connector 512 to retract completely into the housing 510. In other implementations, the access point 550 may be of a size large enough to allow the cable 504, but not connector 512, to pass through. Thus, in some implementations, the cable 504 can retract into the housing 510, but the connector 512 cannot.

As depicted in FIG. 7, the end cap 526 may have a surface near the access point 550 to hinder and/or stop the plunger assembly 514 from passing the end cap 526 and/or exiting the housing 510. The surface of the end cap 526 may be compatible to contact a face of the plunger head 522. The end cap 526 may also be arranged to ensure that the point 542 of the helical segment 506 of the cable 504 does not exit the housing 510 to keep the helical segment 506 protected from environmental factors and maintain functionality of the cable assistance apparatus 500. For example, the plunger head 522 may be coupled to the cable 504 to stop the cable 504 from extending when the plunger head 522 contacts the end cap 526 and the plunger head 522 may be sufficiently large that the clearance between the plunger head 522 and the housing 510 is less than the width of the cable 504 of the helical segment 510. It my also be desirable to configure or position the end cap 526 to stop the cable 504 at a maximum payout distance. For example, the plunger head 522 may be affixed at a point on the cable 504 associated with the maximum payout distance to stop the cable 504 when the plunger head 522 contacts the end cap 526.

The end cap 526 may be made out of a sturdy material, such as carbon fiber, to prevent the disruption or damage to the cable assistance apparatus 500 when the face and/or surface of the plunger head 522 contacts the surface of end cap 526 at a rate of extension provided by an average external force used to extend the cable 504. The access point 550 may allow a user to grasp a segment of the cable 504 and apply a force on the cable 504. For example, the access point 550 may be accessible by a user's hand to pull on the connector 512 or segment of cable 504 directly connected to the connector 512 and extend the cable 504 to an electrical source.

A ring brush 528 may be coupled to the end cap 526. The ring brush 528 may have a rim with a plurality of bristles extending from the rim towards the center of the ring brush 528. The bristles of the ring brush 528 may cover at least a part of the access point 550 to hinder an environmental factor from entering the housing 510. For example in FIGS. 5-7, the ring brush 528 may have an inner diameter smaller than the diameter of the access point 550. Also depicted from FIGS. 5-7, the inner diameter may preferably be about the size of the width of the cable 504. The ring brush 528 may have rubber ring around inner diameter to ensure a close connection to the cable 504. The bristles of the ring brush 528 may hinder dirt or pebbles from entering the housing 510 or partially clean the cable 504 as the cable 504 enters the housing 510.

Figure 8:
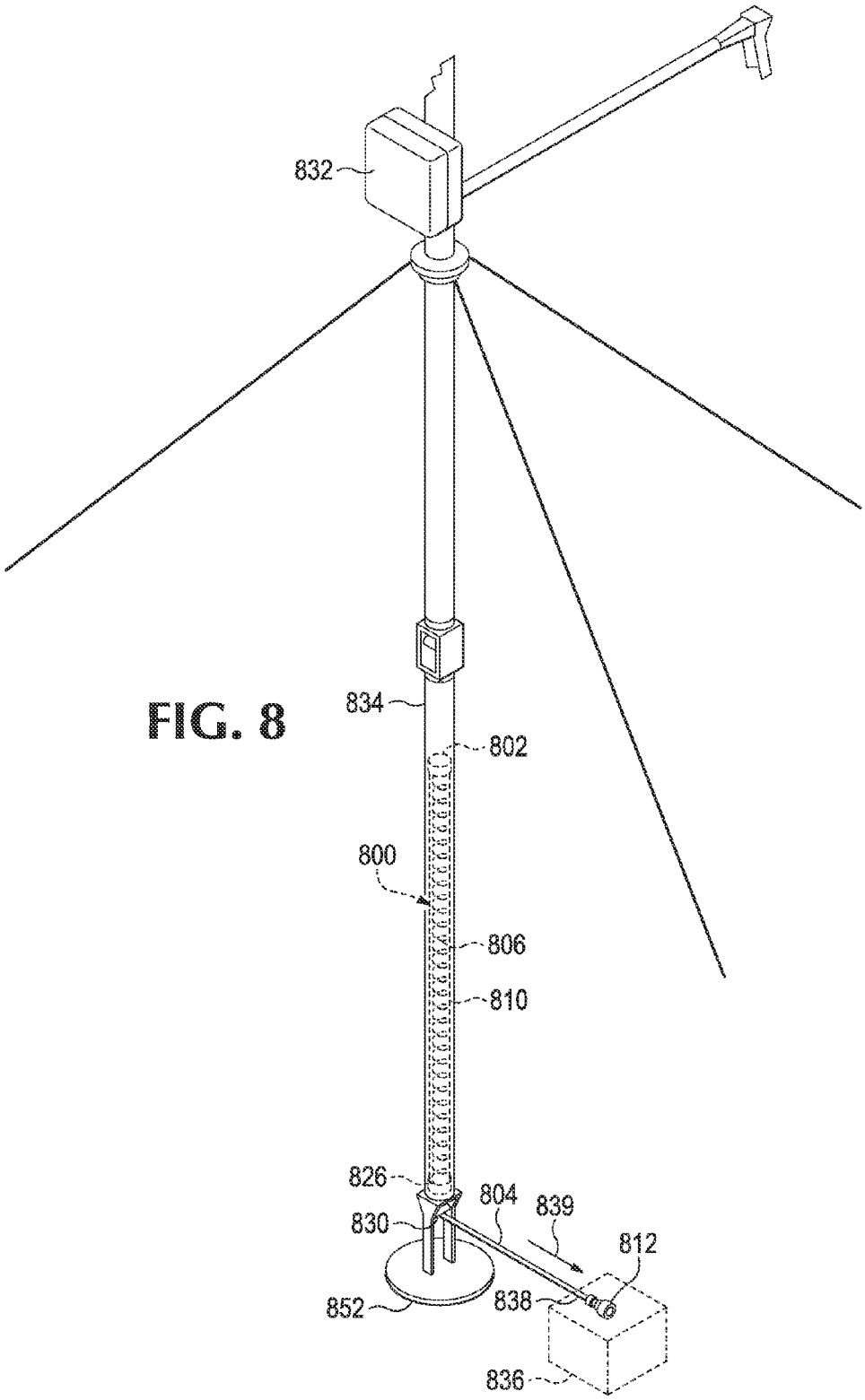
FIG. 8 is a perspective view of one example of a cable assistance system.
Figure 9:
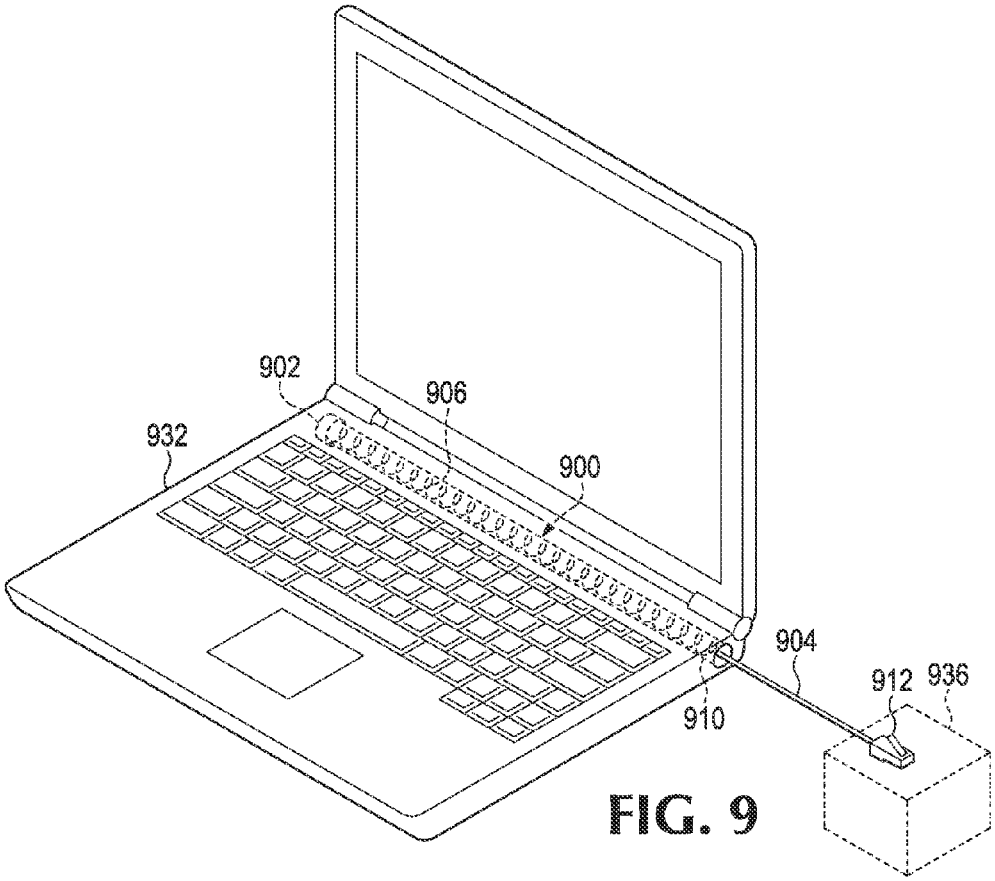
FIG. 9 is a perspective view of one example of a cable assistance system.
Figure 10:
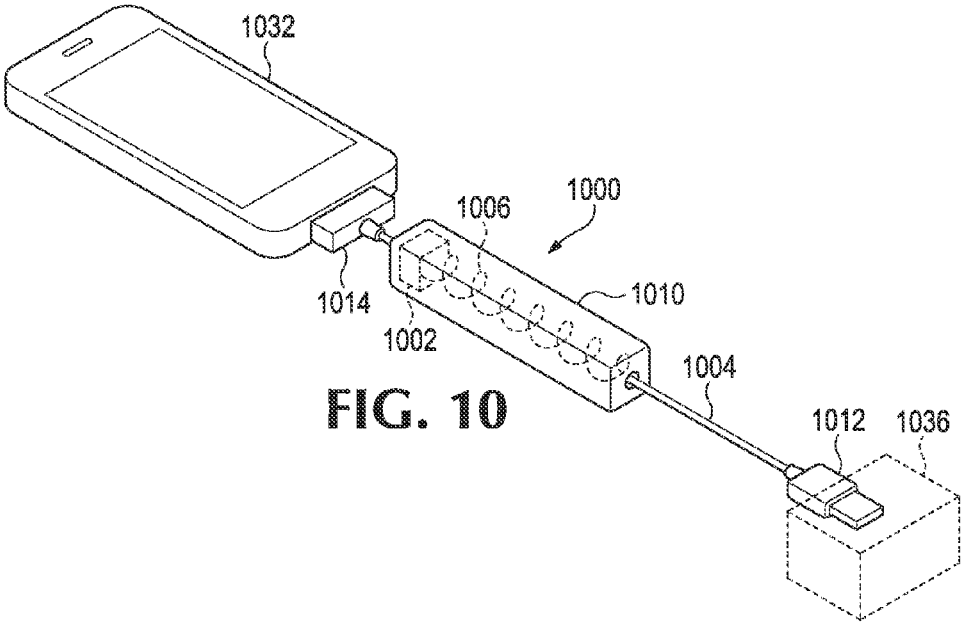
FIG. 10 is a perspective view of one example of a cable assistance system.

FIGS. 8-10 are perspective views of examples of a cable assistance system 800. FIG. 8 is a perspective view of an example of a cable assistance system 800 connecting an antenna system 832 to an electrical source 836. Referring to FIG. 8, the cable assistance system 800 generally comprises a housing 810, a cable 804, and an assist mechanism 802. When deploying an antenna system 832 that may require an electrical connection, the cable 804 of the cable assistance system 800 may provide an electrical connection between an antenna system 832 and an electrical source 836. For example, a user may set up a portable mast 834 with an antenna system 832 connected to a housing 810 for a cable 804, seize a portion of the cable 804 extending from the housing 810, extend the cable 804 using a force 839, and connect the cable 804 to an electrical source 836. When taking down the portable mast 834, the cable 804 may be disconnected from the electrical source 836, and the assist mechanism 802 may retract the cable 804 into the housing 810 for stowage.

The cable 804 may include multiple segments and may be an electrically conductive cable. The cable 804 may include a first segment 806 having a helical shape. The cable 804 may have a connector 812 to connect to the electrical source 836. The cable 804 may be adjustable among a plurality of configurations. For example, the cable 804 may at least partially be disposed within the housing 810 in a retraction configuration and the cable 804 may be at least partially exit the housing 810 in an extension configuration. The cable 804 may entirely fit within the housing 810 or may have a segment within the housing 810 and a segment outside the housing 810. The assist mechanism 802 may be contained within a part of the housing 810 to protect it from environmental factors. One end of the cable 804 may have a connector 812 compatible with an electrical source 836.

The cable 804 and the connector 812 may be electrically conductive. The cable 804 may provide power, a communications medium, a diagnostic medium, or a combination of power, communications, and/or diagnostic information from the electrical source 836. The electrical source 836 may comprise a battery pack to provide power to the antenna system 832. The electrical source 836 may include a communication element to transmit and/or receive diagnostic information such as a transceiver or receiver. For example, the electrical source 836 and cable 804 may be compatible with PoE technology and the cable 804 may provide a power and communications medium between the antenna system 832 and the electrical source 836. The electrical source 836 may also include an electrical splitter for a plug-in for the battery box to provide electrical power and obtain diagnostic information.

The electrical source 836 may be within a maximum payout length range of the portable mast. For example FIG. 8, the electrical source 836 may need to be within a distance from the base 852 of the portable mast 834 that is less than the length of the housing 810. The payout length may be determined by a ratio of the length of the housing 810 and/or based on the helical shape and span of a helical segment of the cable 804. For example, the payout length ratio may be between one and two tenths of the length of the housing 810.

The assist mechanism 802 may be operatively connected to the cable 804. The assist mechanism may apply a force, such as a retraction force, on the cable 804 to adjust the cable 804 from an extension configuration to a retraction configuration.

The housing 810 may couple to the antenna system 832 to at least partially dispose the cable 804 within the housing 810. The housing 810 may connect to the antenna system 832 or integrate into part of the antenna system 832. For example in FIG. 8, the housing 810 may be inside the tower portion of the portable mast 834 of the antenna system 832. Alternatively, the lower portion of the portable mast 834 may be the housing 810.

The housing 810 may include an end cap 826. One or multiple segments of cable 804 may fit within the housing 810. For example, when adjusting to a retraction configuration, the end cap 826 may also separate the connector 812 on the end of the cable 804 and the segments of cable 804 inside the housing 810 from segments of cable 804 outside the housing 810. In another example, the retraction configuration may result in the end cap 826 separating a connector segment 838 of the cable 804 to allow a user to extend the cable 804 by the connector segment 838 rather than applying force on the connector 812. The segments of the cable 804 inside the housing 810 may be helical and/or non-helical. In FIG. 8 depicting the cable 804 in an extension configuration, a helical segment 806 may be inside the housing 810 and other cable segments, as well as the connector segment 838 of the cable 804 near the connector 812, may be outside the housing 810. In one example when the cable 804 is in a retraction configuration, the helical segment 806 and the other cable segments between the helical segment 806 and the connector segment 838 may be disposed within the housing 810 while the connector segment 838 may extend past the end cap 826 and the connector segment 838 may be connected to the connector 812.

The end cap 826 may form an access point to receive a portion of the cable 804. The end cap 826 may have a surface to hinder or stop a helical segment of the cable from exiting the housing 810 when changing to an extension configuration.

A roller 830 may be operatively coupled to a lower portion of the portable mast such as a base 852, the housing 810, and/or the end cap 826. The roller 830 may assist a segment of the cable 804 as the segment changes position or while the cable 804 adjusts. For example, the roller 830 may facilitate retraction or extension of a non-helical segment of the cable 804 by guiding the cable 804 over a wheel or bearing that spins substantially freely. The roller 830 may guide the cable 804 to bend when being pulled out of the housing 810, as depicted in FIG. 8, or retracting back into the housing 810 without unnecessary wear or scuffing on the cable 804, housing 810, or end cap 826.

The antenna system 832 may be one of many antenna systems used in a seismic survey deployment strategy. The antenna system 832 may be any form of seismic survey equipment including a portable antenna mast 834. In particular, the antenna system 832 may include a portable mast 834 where the lower portion of the portable mast 834 may be the housing 810 for the cable assistance system 800. The antenna system 832 may include an inclinometer that may transmit and/or receive information over the cable 804 to and/or from an electrical source 836.

Referring to FIG. 9, the cable assistance system 900 generally comprises a housing 910, a cable 904, and an assist mechanism 902. The housing 910 may connect to a system or device or, as depicted in FIG. 9, be a part of a housing of a system or device 932. The cable 904 may be extended from the housing 910 to connect to an electrical source 936. For example in FIG. 9, the cable 904 from within the laptop computer system 932 to extend to connect to an Ethernet port on an electrical source 936. Electrical source 936 may be a power adapter, electrical outlet, PoE port, or other electrically conductive source.

The cable 904 may connect to the electrical source 936 using a compatible connector 912. When the system or device 932 needs to be transported or is otherwise no longer in need of the connection to the electrical source 936, the user may disconnect the cable 904 from the electrical source 936 and the assist mechanism 902 may operate on a segment 906 of the cable 904 to retract the cable 904 into the housing 910 of the system or device 932.

The cable assistance system 900 as described may provide protection from environmental factors when the laptop computer system 932 of FIG. 9 is used in harsh or extreme environments, such as a desert, or in situations where quickly moving among camp sites and setting up the system or device 932 may be important. A cable 904 that retracts into a transportable housing 910 based on configurations of a helical segment of the cable 904 may be a preferable over coiling or winding up cables from power adapters or other electrical source connections by hand.

Referring to FIG. 10, the cable assistance system 1000 generally comprises a housing 1010, a cable 1004, and an assist mechanism 1002. The cable 1004 may provide a connection between an electrically conductive source 1036 and a system or device 1032. The cable assistance system 1000 may be electrically connected to the electrical source 1036 and the system or device 1032 may be electrically connected to the cable assistance system 1000. The cable assistance system 1000 may provide a medium for power and/or communications between the electrical source 1036 and the system or device 1032. For example in FIG. 10, the mobile device 1032 may connect to the cable assistance system 1000 through a device connector 1014 and the cable 1004 of cable assistance system 1000 may be extended and connected to a USB connection port of the electrical source 1036 through a source connector 1012 to provide power and/or communications to the mobile device 1032. The electrical source 1036 may be an electrical outlet, computer, or other system or device. As depicted in FIG. 10, a cable assistance apparatus 1000 may be detachable and used among systems or devices with compatible electrically conductive connections. Cable segment 1006 may retract into the housing 1010 to stow cable 1004, and the housing 1010 may be of a size compatible with the device 1032 and/or convenient for transportation. In conditions that may require more payout length, the cable assistance system 1000 may employ multiple segments or multiple cables within the housing 1010.

The present description has been shown and described with reference to the foregoing exemplary embodiments. It is understood, however, that other forms, details and embodiments may be made without departing from the spirit and scope of the invention that is defined in the following claims.

What is claimed is:

1. A cable assistance apparatus comprising: an electrically conductive cable including a segment having a helical shape about an axis; and an assist mechanism operatively connected to the cable, the assist mechanism to apply a force to adjust: the segment from a first configuration to a second configuration, the first configuration having a first span measured along the axis from a first end of the segment to a second end of the segment, the second configuration having a second span measured along the axis from the first end of the segment to the second end of the segment, wherein the assist mechanism comprises a plunger assembly comprising: a body; and a head rigidly coupled to the body, the head defining an opening through the head and the cable to route through the opening of the head.

2. The cable assistance apparatus of claim 1, wherein the cable further comprises a second segment, the second segment moveable between a first position and a second position, the first position of the second segment associated with the first configuration of the first segment and the second position of the second segment associated with the second configuration of the first segment.

3. The cable assistance apparatus of claim 1, wherein the assist mechanism includes a spring assembly to provide the force.

4. The cable assistance apparatus of claim 3, wherein the assist mechanism includes a plunger assembly operatively connected to the spring assembly, the plunger assembly to apply the force provided by the spring assembly to the cable.

5. A cable assistance apparatus comprising: a housing; a cable at least partially disposed within the housing, the cable including a first segment biased in a helical shape about an axis and a second segment; a plunger assembly operatively connected to the cable, the first segment of the cable to adjust configuration in conjunction with a movement of the plunger assembly substantially along the axis and the second segment of the cable to move in conjunction with the movement of the plunger assembly, wherein the plunger assembly comprises: a head operatively connected to the cable, a portion of the head defining an opening to receive the cable through the head, the head positioned between the first segment of the cable and the second segment of the cable; and a body coupled to the head, the body extending along the interior of the helical shape of the first segment of the cable to move the plunger assembly substantially along the axis; and a spring assembly operatively connected to the plunger assembly, the spring assembly to apply a retraction force on the plunger assembly substantially along the axis.

6. The cable assistance apparatus of claim 5, wherein the spring assembly further comprises a constant force spring connected to the housing.

7. The cable assistance apparatus of claim 5, wherein the cable includes a second segment to connect to an electrical source, the second segment having a non-helical shape.

8. The cable assistance apparatus of claim 5, further comprising an end cap coupled to the housing, the head of the plunger having a face, the end cap having a surface to contact the face of the head of the plunger to hinder the movement of the plunger assembly past the end cap, and a portion of the end cap forming an access, point to receive the cable.

9. The cable assistance apparatus of claim 8, further comprising wring' brush coupled to the end cap, the ring brush having a plurality of bristles at least partially covering the access point to hinder an environmental factor from entering the housing.

10. The cable assistance apparatus of claim 8, further comprising a roller operatively connected to the housing to facilitate guidance of the second segment of the cable.

11. The cable assistance apparatus of claim 5, wherein the spring assembly retracts the cable at a retraction rate below a disturbance threshold.

12. A cable assistance system for connecting an antenna system to an electrical source comprising: a cable at least partially disposed within the housing, the cable including a first segment having a helical shape and a second segment to connect to the electrical source, the cable adjustable among a plurality of configurations; and an assist mechanism operatively connected to the cable, the assist mechanism to apply a retraction force on a head of a plunger assembly coupled to the cable, the cable received through an opening in the head of the plunger assembly and to adjust from an extension configuration of the plurality of configurations to a retraction configuration of a plurality of configurations by adjusting position: of the head of the plunger assembly, wherein: a helical portion of the cable is to change in span along an axis as the head of the plunger assembly adjusts position along the axis.

13. The cable assistance system of claim 12, wherein the cable provides power to the antenna system from the electrical source.

14. The cable assistance system of claim 12, wherein the cable provides communication to the electrical source from the antenna system.

15. The cable assistance system of claim 12, wherein the housing further comprises an end cap having a surface to hinder the first segment from exiting the housing, a portion of the end cap forming an access point to receive the second segment.

16. The cable assistance system of claim 15, wherein the cable further comprises a third segment, the third segment to extend past the end cap when the first segment is in the retraction configuration and the first segment and second segment to be disposed within the housing when the first segment is in the retraction configuration.

* * * * *